US006935839B2

(12) United States Patent
Pascoe

(10) Patent No.: US 6,935,839 B2
(45) Date of Patent: Aug. 30, 2005

(54) VARIABLE FLOW WATER PUMP

(75) Inventor: David Mark Pascoe, Newmarket (CA)

(73) Assignee: Tesma International Inc., Concord (CA)

( * ) Notice: Subject to any disclaimer, the term of this patent is extended or adjusted under 35 U.S.C. 154(b) by 163 days.

(21) Appl. No.: 10/257,815

(22) PCT Filed: Apr. 12, 2001

(86) PCT No.: PCT/CA01/00541

§ 371 (c)(1),
(2), (4) Date: Oct. 14, 2002

(87) PCT Pub. No.: WO01/79703

PCT Pub. Date: Oct. 25, 2001

(65) Prior Publication Data

US 2003/0165383 A1 Sep. 4, 2003

Related U.S. Application Data

(60) Provisional application No. 60/242,619, filed on Oct. 23, 2000, and provisional application No. 60/197,069, filed on Apr. 13, 2000.

(51) Int. Cl.[7] ..... F01D 1/02

(52) U.S. Cl. ..... 415/206; 416/223 R; 417/423.8

(58) Field of Search ..... 415/206, 211.1, 415/208.1–208.4; 416/223 R; 417/423.8, 279, 292

(56) References Cited

U.S. PATENT DOCUMENTS

| | | | | |
|---|---|---|---|---|
| 2,950,686 A | | 8/1960 | Ledel et al. | |
| 3,901,623 A | * | 8/1975 | Grennan | 415/141 |
| 4,012,908 A | * | 3/1977 | Dundore | 60/354 |
| 5,183,392 A | * | 2/1993 | Hansen | 417/203 |
| 5,207,559 A | * | 5/1993 | Clevenger et al. | 415/166 |
| 5,730,580 A | * | 3/1998 | Japikse | 415/208.3 |
| 6,145,313 A | * | 11/2000 | Arnold | 60/605.2 |
| 6,309,193 B1 | * | 10/2001 | Repple et al. | 417/423.8 |

FOREIGN PATENT DOCUMENTS

| | | |
|---|---|---|
| BE | 467868 | 9/1946 |
| FR | 1512443 | 12/1966 |
| FR | 2175393 | 9/1973 |

* cited by examiner

*Primary Examiner*—Edward K. Look
*Assistant Examiner*—James M. McAleenan
(74) *Attorney, Agent, or Firm*—Clark Hill PLC

(57) ABSTRACT

A variable-capacity water pump includes a housing having an impeller mounted on a rotatable shaft. The impeller includes a plurality of vanes pivotally coupled between upper and lower shroud and operatively coupled to a pitch plate. As the pump speed increases in response to increasing engine speed, the pitch plate controls the rotation of the impeller vanes about a fixed rivet from a maximum pitch position, toward a minimum pitch position, thereby lowering pump output according to engine cooling requirements.

9 Claims, 10 Drawing Sheets

VARIABLE FLOW WATER PUMP

This application claims the benefit of Provisional Application Nos. 60/197,069, filed Apr. 13, 2000 and 60/242,619, filed Oct. 23, 2000.

FIELD OF THE INVENTION

The subject invention relates to a variable capacity water pump with an impeller for use in automotive engines and the like.

DESCRIPTION OF RELATED ART

The cooling mechanism for an internal combustion engine used in an automobile normally comprises a coolant pump, commonly referred to as a water pump, of a centrifugal-type. The most common arrangement utilizes the engine rotation to drive a shaft via a belt connection between a driving pulley (connected to the crankshaft) and a driven pulley. The example shown in FIG. 1 shows a typical water pump P with an impeller 20 fastened to a rotating shaft 30 and drivable by the pulley 40, which is attached to the engine crankshaft (not shown). The impeller 20 includes a flange 22 having several integral blades or vanes 24 projecting axially therefrom toward the inlet path 26. When the pulley 40 rotates, the drive shaft 30 rotates, and thus, the vanes 24 similarly rotate with the impeller 20. Coolant enters the passageway 50 and is thrown outward by centrifugal force to an outlet port (not shown) via the outlet path 28.

Although this system is simple, it has the disadvantage of supplying a fixed capacity of coolant that is often unnecessarily large. This over-capacity arises because the pump output is sized to deliver a minimum flow amount of coolant at low engine speeds. At higher engine speeds, such as those experienced under normal highway driving conditions, the flow amount becomes excessive because it is directly proportional to engine speed. This leads to poor cooling efficiencies and increased power losses.

An alternative arrangement uses an electric motor instead of the engine to drive the impeller. For instance, U.S. Pat. No. 3,840,309 discloses a variable capacity centrifugal pump with vanes that move via a pivoting linkage mechanism between a threaded nut and a cross-mount that is attached to a propeller shaft rotated by an electric motor. However, this type of design adds weight and cost because extra components are required. Also, the capacity of the battery and generator needs to be increased in order to supply the extra power needed by the motor.

Still further, U.S. Pat. Nos. 4,752,183 and 5,169,286 disclose two similar variations of a variable output centrifugal pump utilizing a shroud with recesses through which the vanes protrude. The shroud is axially moved over the vanes to vary the exposed area and, therefore, the quantity of coolant that flows through the water pump. This design fails to properly control fluid flow into the volute and allows coolant to pass beneath the impeller. Furthermore, it does not allow for varying the pump capacity with the engine rotational speed.

SUMMARY OF THE INVENTION

The present invention provides a water pump having variable capacity in accordance with a relatively simple mechanical means that obviates the need for expensive electric motors or shrouds that can cause turbulent flow.

According to the present invention, a variable capacity coolant pump includes a pump body for directing the flow of fluid through the pump between an inlet and an outlet and a shaft rotatably connected to the pump body. An impeller is coupled to the pump body for pumping fluid through the pump body from the inlet to the outlet. The impeller includes a shroud and at least one vane pivotally coupled to the shroud for pivotal movement between a plurality of pitch angles relative to the shaft. A pitch plate is operatively coupled to the vane for controlling the pitch angle of the vane. A spring is coupled to the pitch plate for biasing the vane to a maximum pitch angle wherein the vane varies in pitch in response to a force of fluid pressure from the inlet and automatically reduces the pitch angle of the vane upon an increase in the fluid pressure from the inlet to reduce the flow of fluid to the-outlet. In an alternative embodiment, the pitch angle is also controlled externally via an actuator.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
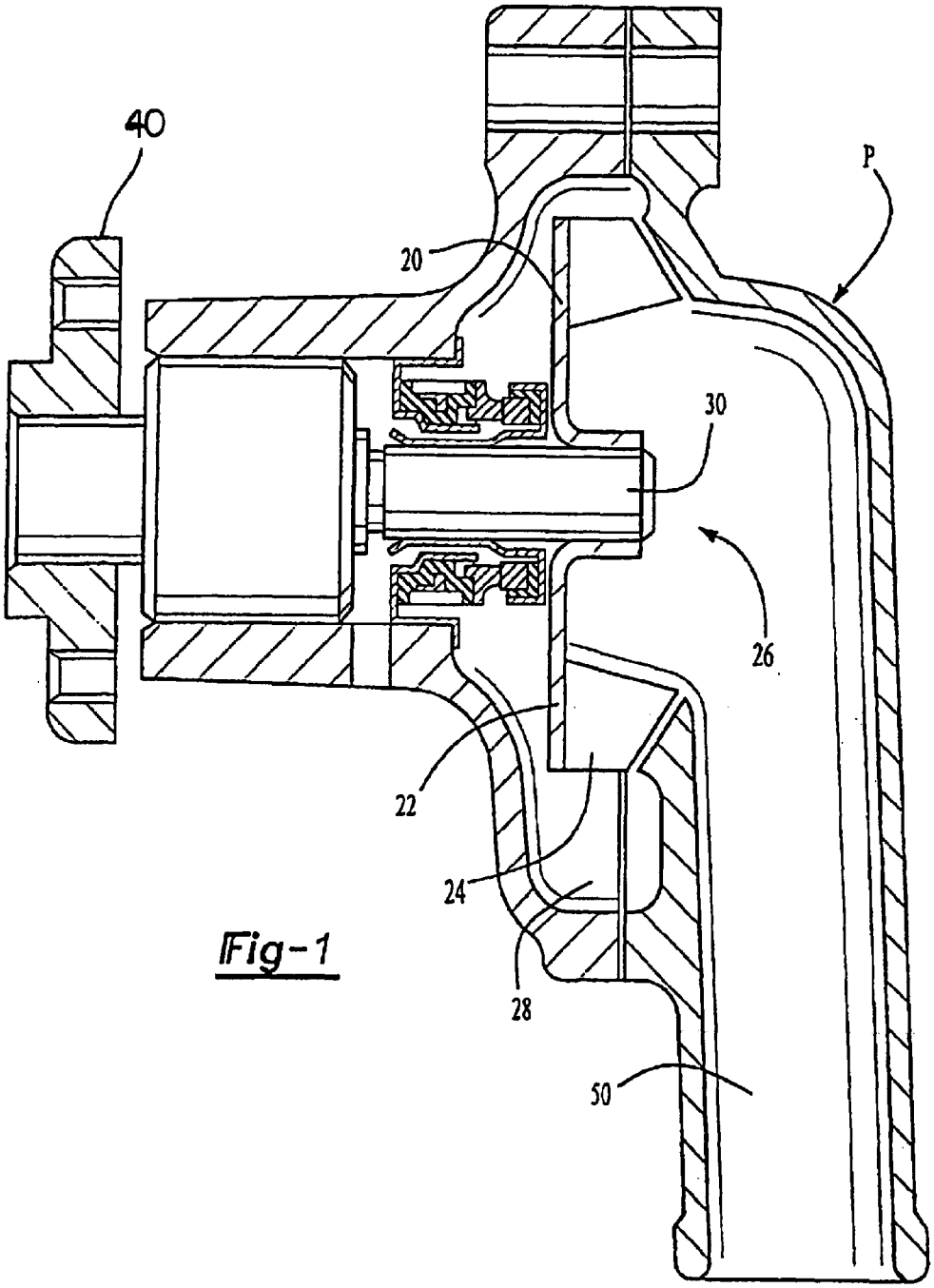
FIG. 1 is a cross-sectional view of a prior art water pump.
Figure 2:
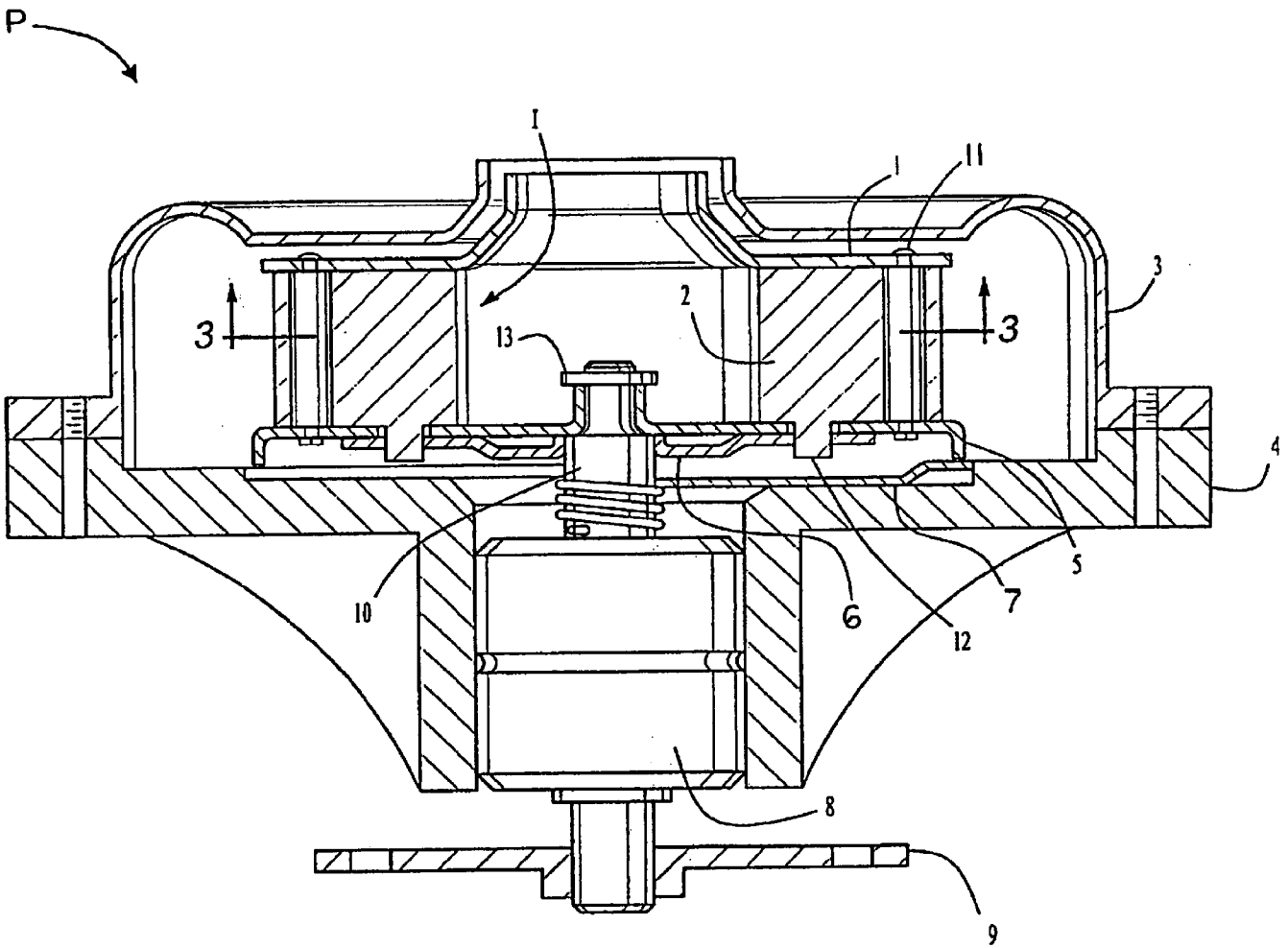
FIG. 2 is a cross-sectional view of a water pump of one embodiment according to the present invention.

Referring to the Figures, wherein like numerals indicate like or corresponding parts throughout the several views, FIG. 2 shows a first preferred embodiment of a variable capacity coolant pump, or water pump P comprised of a housing 4 including an impeller I. The impeller I is fastened to a rotatable shaft 10 drivable by a pulley (not shown) that is belt driven from the engine crankshaft in a well-known manner.

Figure 3:
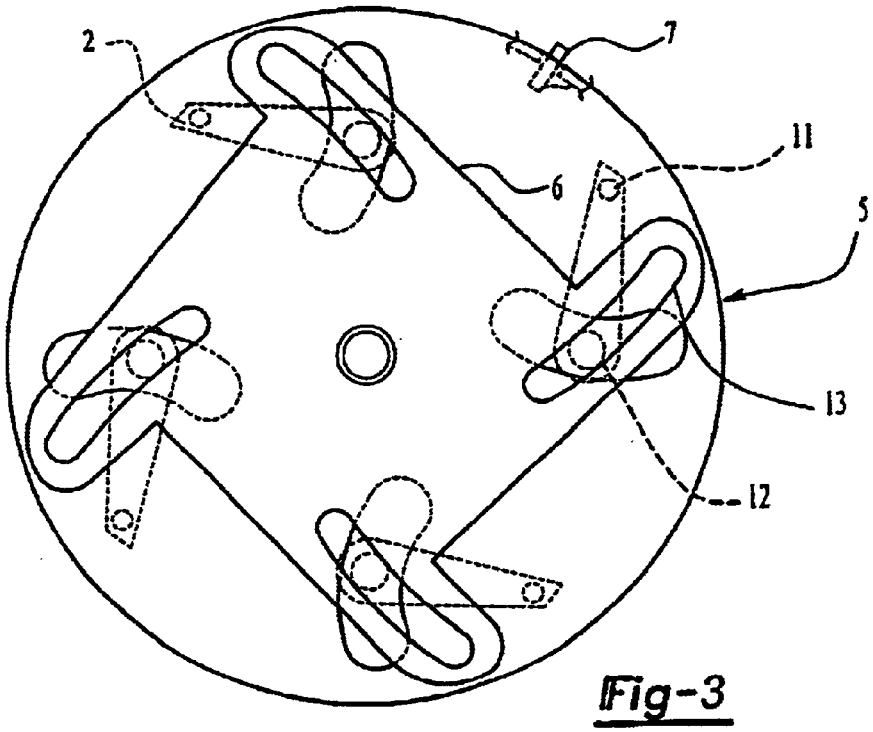
FIG. 3 is a top view of a pitch plate of the water pump according to FIG. 2.
Figure 4:
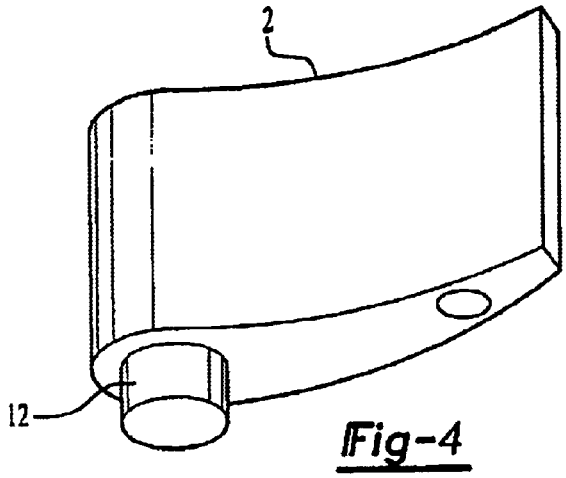
FIG. 4 is a perspective view of an impeller vane and pitch control tab of the water pump according to FIG. 2.

The impeller I includes a lower flange or shroud 5 having a plurality of pivotal vanes 2 projecting axially toward the inlet path of the pump. Each vane 2 is connected to an upper flange or shroud 1 via rivets 11 and guided within arcuate shaped slots 3*a*, 3*b* between the shrouds 1, 5. Directly underneath the lower shroud 5, and rigidly connected to the rotatable shaft 10, is a pitch plate 6 having slots 13 to accommodate the pitch control tabs 12 projecting from the bottom of each of the plurality of vanes 2, as best shown in FIGS. 3 and 4.

Further, a torsional pitch spring 7 is disposed around the rotatable shaft 10, and extends to the edge of the lower shroud 5, such that the torsional spring 7 normally biases the impeller I to its most forward position, where the vanes 2 are held in their highest pitch position. The slots 13 in the pitch plate 6 restrict the movement of the vanes so that they are set to an optimal position, or pitch, for low pump rotational speeds.

Figure 5A:
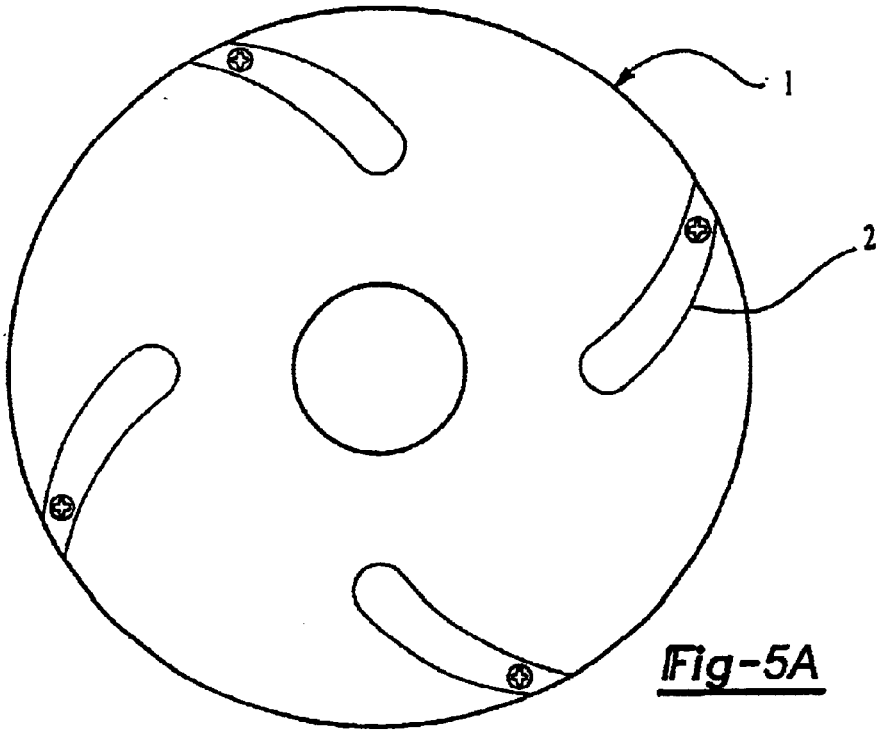
FIG. 5*a* is a partial section view of a water pump according to FIG. 2 showing the location of the vanes in the highest pitch position.
Figure 5B:
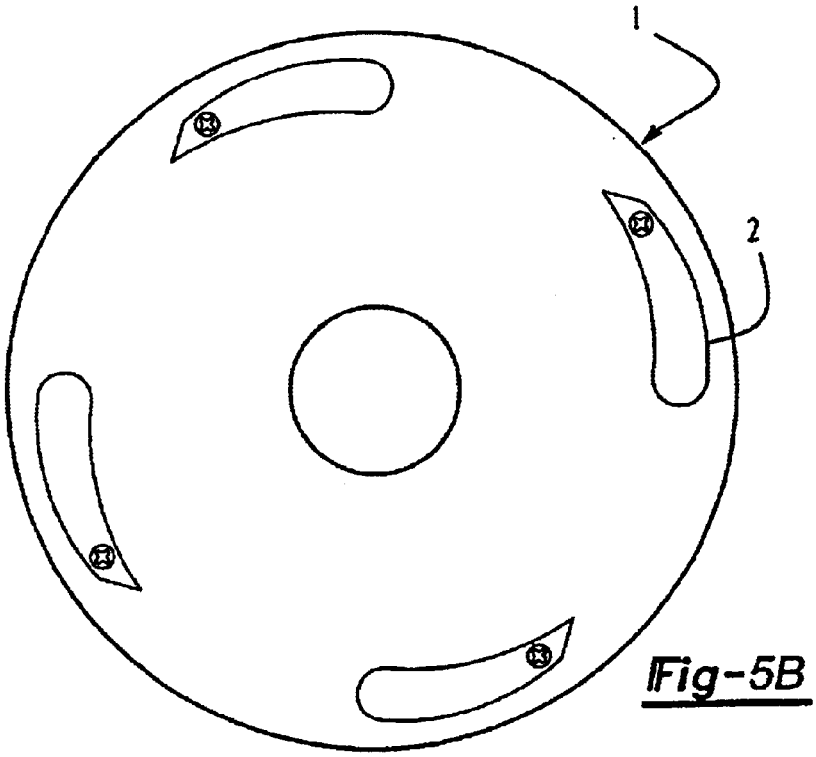
FIG. 5*b* is a partial section view of a water pump according to FIG. 2 showing the location of the vanes in the lowest pitch position.
Figure 7:
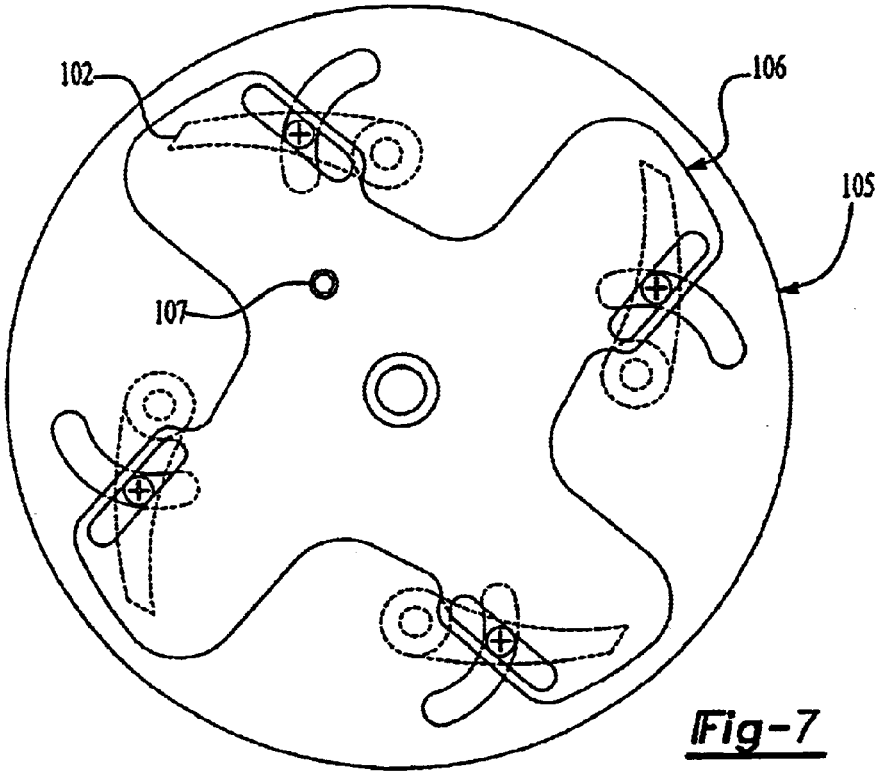
FIG. 7 is a top view of the pitch plate of the water pump according to FIG. 6.

In operation, when the engine is first started, the torsional pitch spring 7 holds the impeller in its most forward position. The vanes 2 rotate about their rivets 11 and are held in their highest pitch position, as shown in FIG. 5*a*. The highest pitch position may be further defined by the vanes 2 extending generally transverse or approaching perpendicular to the center axis of the shroud 1. As the pump speed increases, the drag torque on the impeller I increases, causing the impeller I to rotate in a reverse direction relative to the pitch plate 6. This movement of the impeller I relative to the pitch plate 6 causes the vanes 2 to rotate about their rivets 11 to a lower pitch position, as shown in FIG. 5*b*. The lower pitch position may be further defined by the vanes arranged generally parallel with the circumferential outer edge of the shroud 1. A force balance is realized between the torsional pitch spring 7, which biases the impeller I to its forward most position (and vanes 2 in the highest pitch position), and the fluid drag torque, which biases the impeller I to its rearward position (and vanes 2 in the lowest pitch position).

Therefore, as the pump speed increases in response to increasing engine speed, the vanes 2 rotate about their rivets 11 from their highest pitch position, illustrated in FIG. 5*a*, toward their lowest pitch position, illustrated in FIG. 5*b*. The guiding slots 13 that are cut into the pitch plate 6 limit the maximum position, or range of movement, of the vanes 2 to a predetermined limit, dependent on engine cooling requirements.

Figure 8:
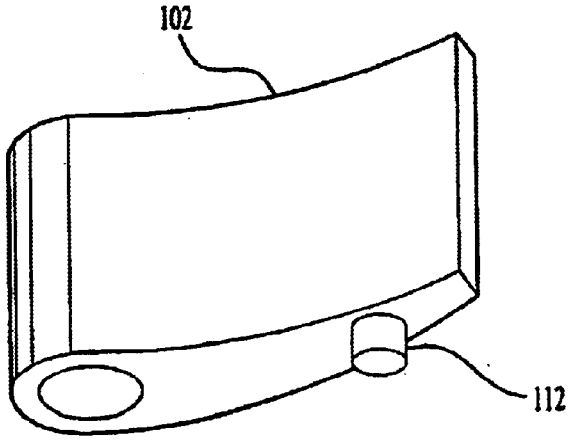
FIG. 8 is a perspective view of the impeller vane and pitch control tab of the water pump according to FIG. 6.
Figure 6:
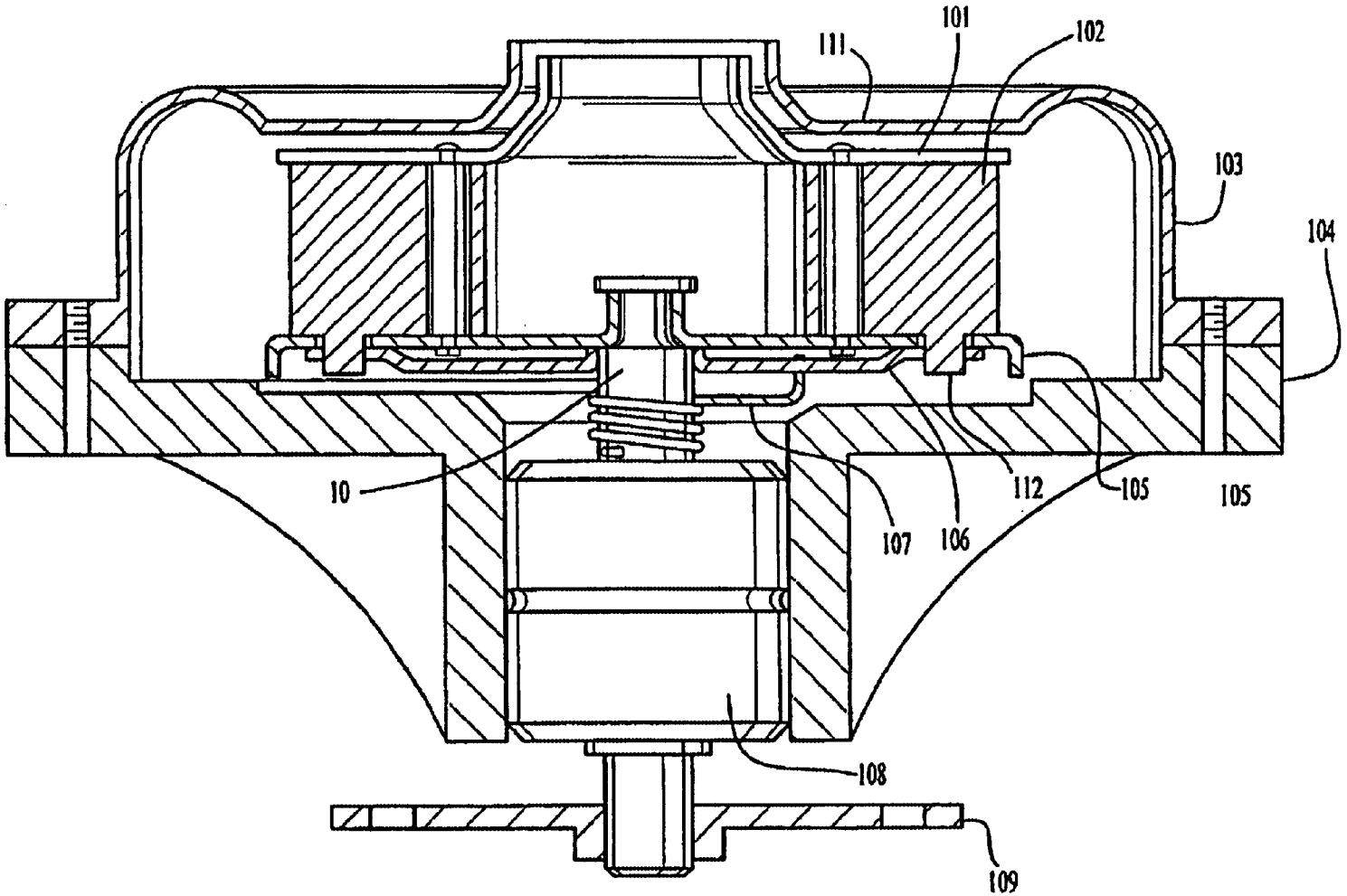
FIG. 6 is a cross-sectional view of a water pump of a second embodiment according to the present invention.

Referring now to FIGS. 6–9, another embodiment of the impeller arrangement is illustrated. The essential elements are arranged in a similar fashion as before, except that the pitch plate 106 is axially fixed to the rotational shaft 10, but is rotationally free thereon and is affected by the torsion pitch spring 107, which no longer contacts the lower shroud 105. Further, the pitch control tabs 112 are now located on the outer edges of the vanes 102, and the rivets 111 are located on the opposite edge, as shown in FIGS. 6 and 8.

Figure 9A:
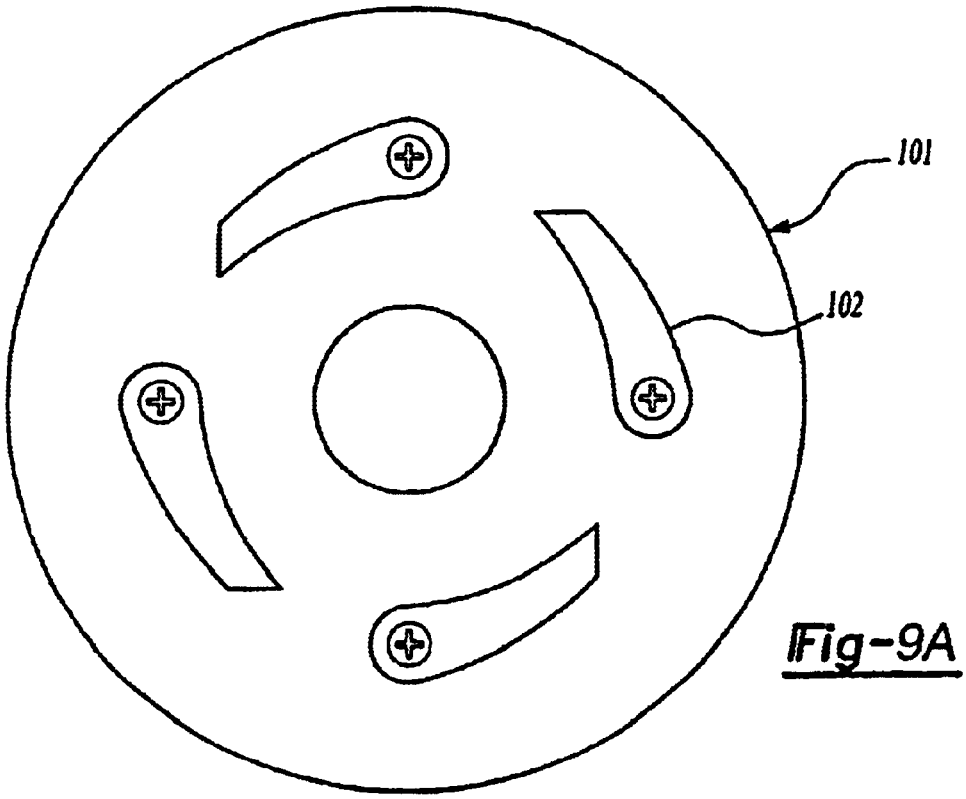
FIG. 9*a* is a partial section view of a water pump according to FIG. 6 showing the location of the vanes in the highest pitch position.
Figure 9B:
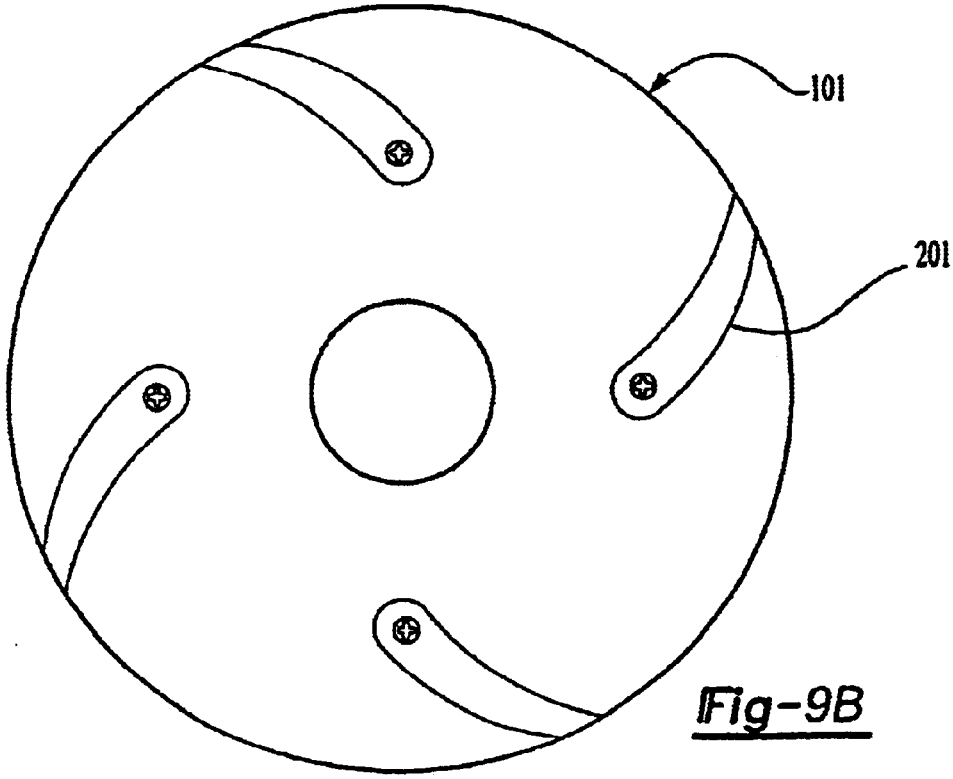
FIG. 9*b* is a partial section view of a water pump according to FIG. 6, and showing the location of the vanes in the lowest pitch position.

At low rotational speeds, the torsion pitch spring 107 holds the vanes 102 in their outer most, or highest pitch, position, shown in FIG. 9*a*. The torsional pitch spring 107 reacts against the rotational shaft 110 and rotates the pitch plate 106 against the pitch control tabs 112 on the bottom of the vanes 102. As the pump rotational speed increases, the fluid pressure on the vanes 102 causes the vanes 102 to rotate about their rivets 111 against the pressure being applied to the pitch control tabs 112 by the pitch plate 106. A balance of forces is once again achieved, where the force exerted by the torsional pitch spring 107 onto the vanes 102 is opposed by the back pressure of the fluid flowing across the forward face of the vanes 102. At high rotational speeds, the vanes 102 are rotated to their lowest pitch positions, illustrated in FIG. 9*b*.

Figure 10:
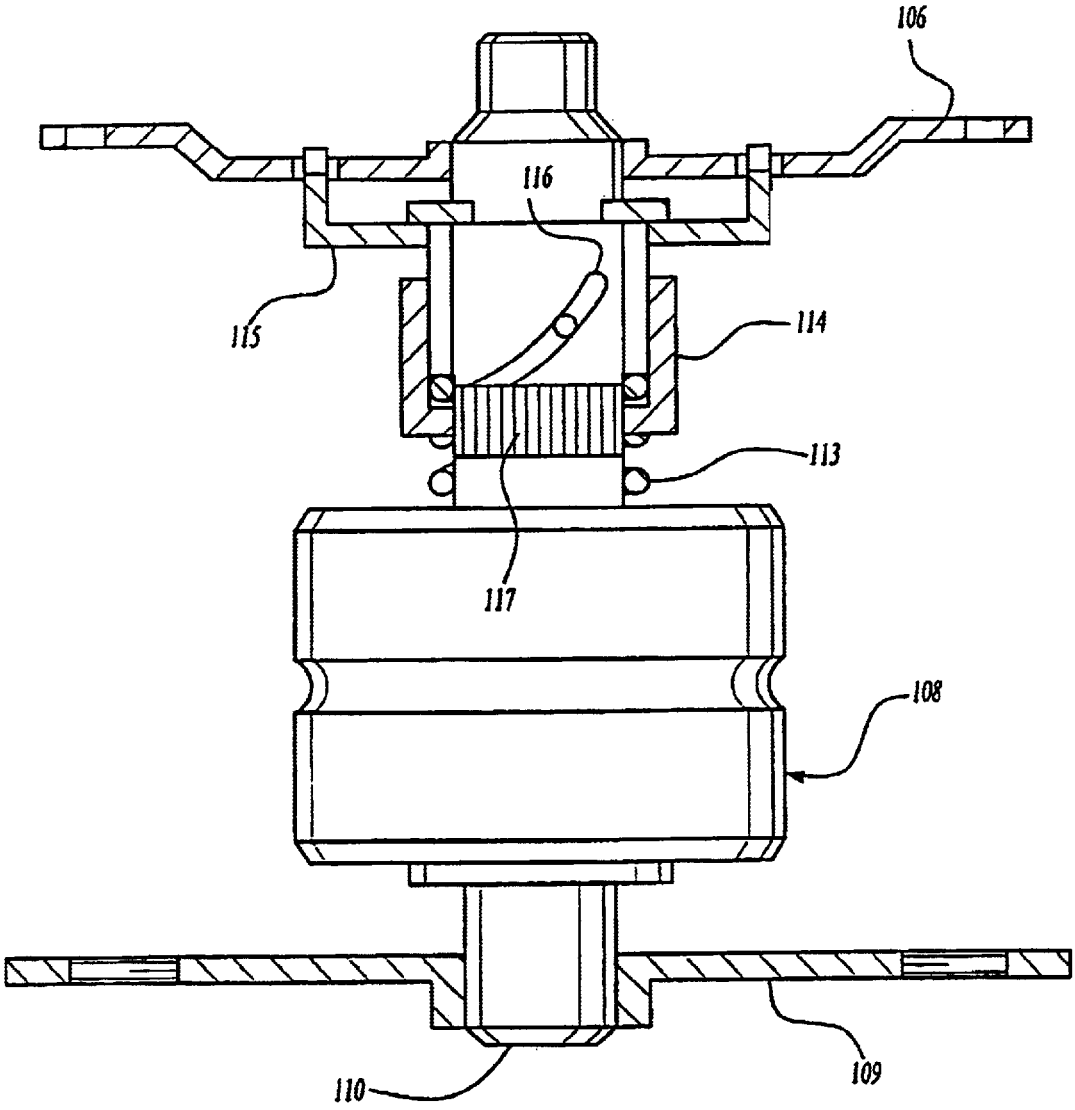
FIG. 10 is a partial cross-sectional view of a water pump of a third embodiment according to the present invention.

FIG. 10 discloses an alternate embodiment whereby the torsional pitch spring is replaced by a compression pitch spring 113, a sliding shell 114, a helically motivated rotating shell 115 and a C-clip 116. The sliding shell 114 is rotationally fixed onto the main rotational shaft 110 by the spline 117, and the rotating shell 115 is axially fixed by the C-clip 116. Tabs 119 on the sliding shell 114 consequently impart a rotating torque onto the rotating shell 115 by applying an axial force to a helical slot 120 in the rotating shell 115. The combination of compression pitch spring 113, sliding shell 114, rotating shell 115 and the straight spline 117 applies the same outward force to the vanes 102 by imparting a rotating force onto the pitch plate 106. This applies an outward force to the pitch control tab 112 located on the bottom of the vane 102. The rotating force is generated when the compression pitch spring 113 axially pushes the sliding shell 114 against the rotating shell 115. The outward force on the vanes 102, derived from the compression spring 113, is again balanced by the fluid pressure acting on the vanes.

Figure 13:
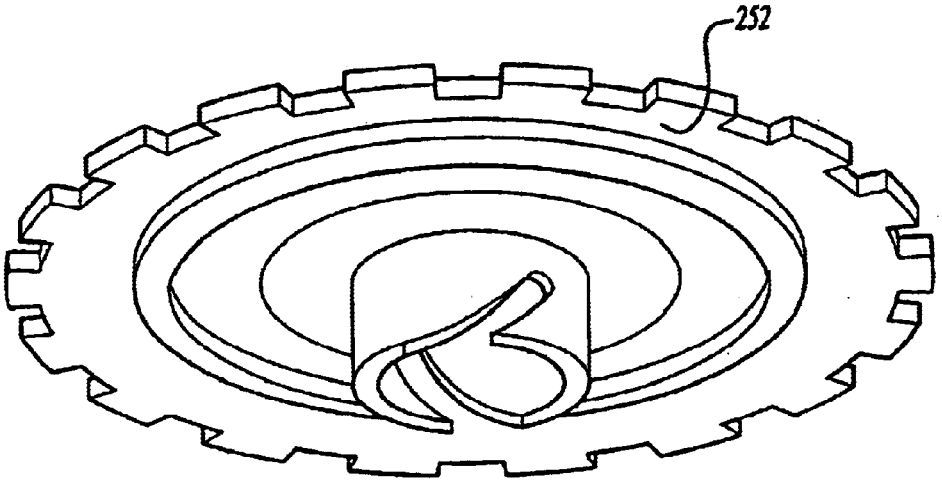
FIG. 13 is a perspective view of the pitch plate of FIG. 11.
Figure 11:
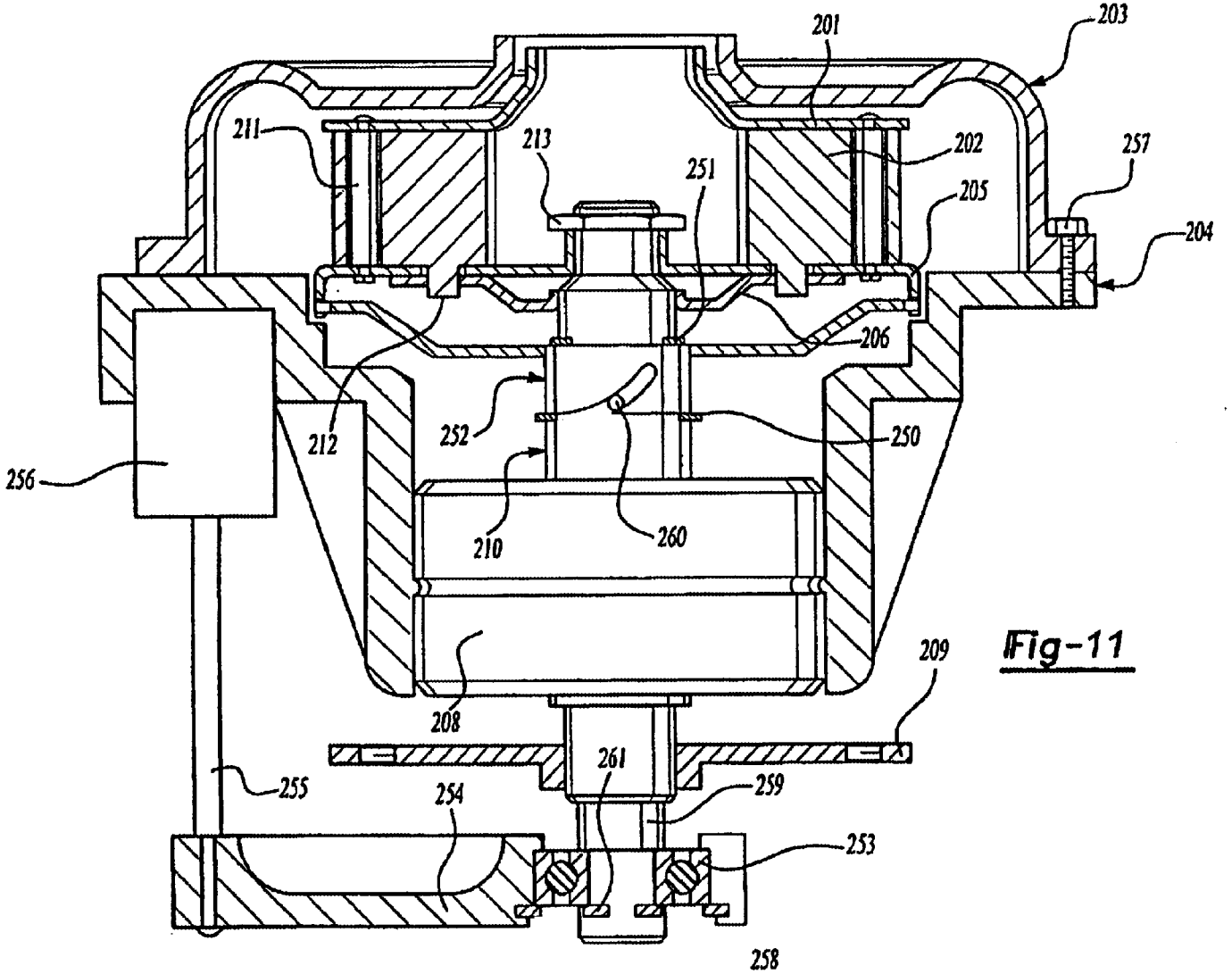
FIG. 11 is a cross sectional view of a water pump of a fourth embodiment according to the present invention.
Figure 12:
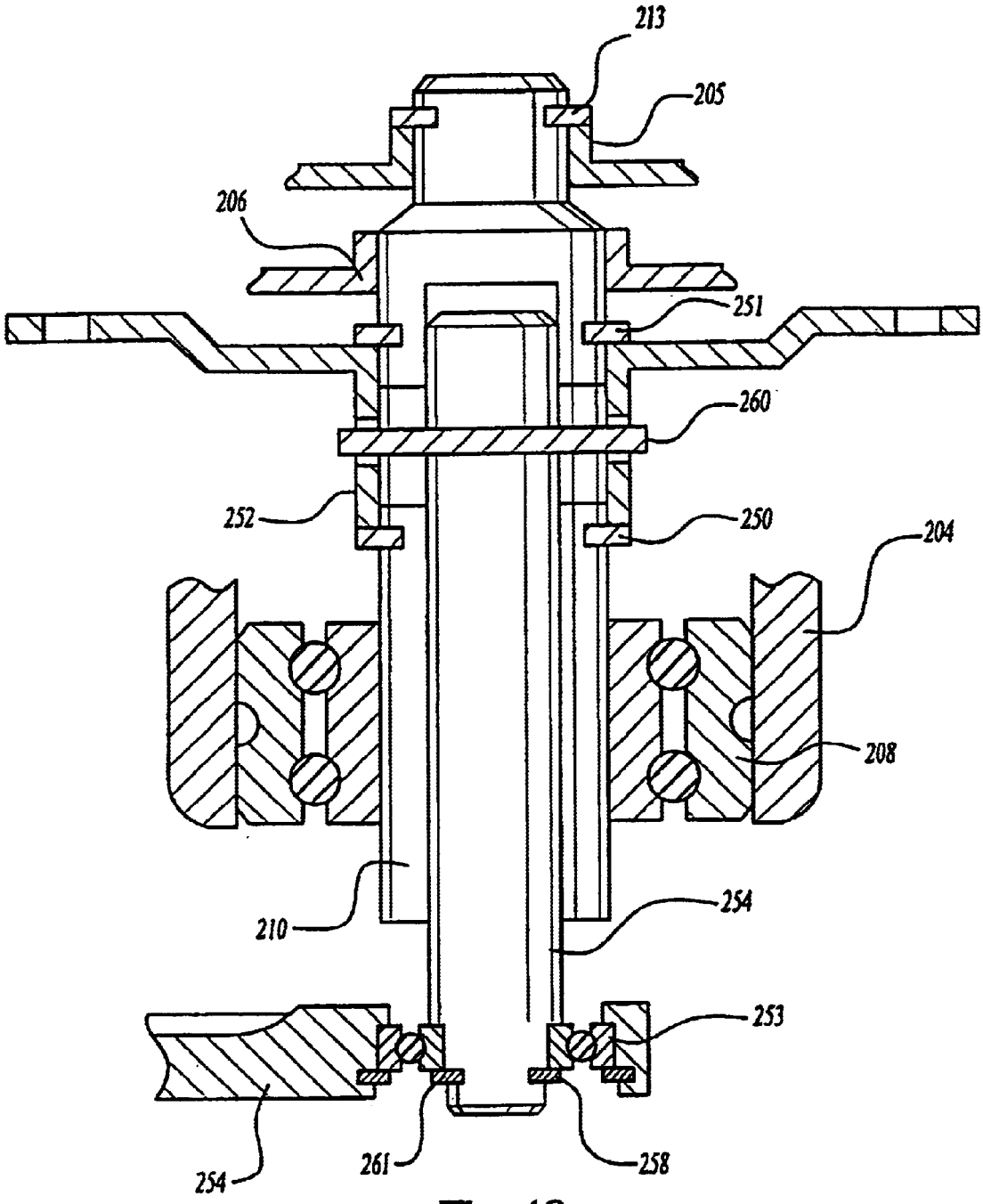
FIG. 12 is a partial section of the water pump according to FIG. 11, showing details of the internal moving parts.

Finally, FIGS. 11–13 illustrate yet another alternate embodiment of the invention whereby the vane pitch is controlled by an external actuator 256. In operation, the actuator 256 moves the rod 255 axially. An arm 254 connects the rod 255 to a bearing 253. The subsequent motion of the rod 255 and arm 254 combination causes the bearing 253 to move axially. The bearing 253 then drives the control rod 259 axially. The internal shaft is rigidly attached to pin 260, which acts on the helical grooves 262 in the rotation shell 252, illustrated more clearly in FIG. 13, to cause it to rotate. The direction of rotation, clockwise or counterclockwise, depends on the direction that the control rod 259 moves in. The rotation shell 252 acts on or otherwise engages the lower shroud 205, and, indirectly, the entire impeller sub-assembly, causing the sub-assembly to rotate. The pitch plate 206, which is rigidly attached to the rotating shaft 210, acts on the pitch control tabs 212 of the vanes 202 to change the pitch of the vanes 202. In operation, an external electronic controller can be used to determine the vane 202 pitch angle for a given pump speed and engine temperature.

Having now fully described the invention, any changes can be made by one of ordinary skill in the art without departing from the scope of the invention as set forth herein. For example, the pitch plate or vanes can also be driven by an electronic or hydraulic actuator. Further, the pitch plate could be replaced by a set of linkages.

The invention has been described in an illustrative manner, and it is to be understood that the terminology which has been used is intended to be in the nature of words of description rather than of limitation. Many modifications and variations of the present invention are possible in light of the above teachings. It is, therefore, to be understood that within the scope of the appended claims, the invention may be practiced other than as specifically described.

What is claimed is:

1. A variable capacity coolant pump comprising:

a pump housing for directing the flow of fluid through said pump between an inlet and an outlet;

a shaft rotatably journaled to said pump housing;

an impeller coupled to said pump housing for pumping fluid through said pump housing from said inlet to said outlet, said impeller rotatably journaled to said shaft and including an upper shroud and a lower shroud spaced below and generally parallel to said upper shroud and at least one vane pivotally coupled between said upper and lower shrouds for pivotal movement between a plurality of pitch angles relative to said shaft;

a pitch plate fixedly secured to said shaft for rotation therewith and operatively coupled to said vane for pivoting said vane relative to said upper and lower shroud and controlling said pitch angle of said vane; and a spring coupled to said pitch plate for biasing said vane to a maximum pitch angle, wherein said vane varies in said pitch in response to a force of fluid pressure from said inlet and automatically reduces said pitch angle of said vane upon an increase in said fluid pressure from said inlet to reduce the flow of fluid to said outlet.

2. A variable capacity coolant pump as set forth in claim 1 wherein said impeller includes a plurality of vanes each pivotally coupled between said upper and lower shrouds by a rivet.

3. A variable capacity coolant pump as set forth in claim 1 wherein each of said vanes extends between opposite first and second ends, said first ends pivotally coupled between said upper and lower shrouds by said rivets.

4. A variable capacity coolant pump as set forth in claim 3 wherein said second ends of said vanes includes a pitch control tab extending outwardly therefrom and said pitch plate includes a plurality of slots for slidably receiving said respective pitch control tabs of said vanes to guide and limit the pivotal movement of said vanes between said pitch angles.

5. A variable capacity coolant pump as set forth in claim 4 wherein each of said upper and lower shrouds include arcuate shaped slots for slidably receiving and guiding said pitch control tabs therein during said pivotal movement between said pitch angles.

6. A variable capacity coolant pump as set forth in claim 5 wherein said slots in said upper and lower shrouds at least partially axially intersect with said slots in said pitch plate.

7. A variable capacity coolant pump as set forth in claim 6 wherein said pitch plate includes a generally planar disc-shaped plate fixedly secured to said rotatable shaft.

8. A variable capacity coolant pump as set forth in claim 7 wherein said spring includes a torsion spring connected between said rotatable shaft and one of said shrouds for biasing said vanes to said maximum pitch angle defined as being generally transverse to said rotational axis of said shaft.

9. A variable capacity coolant pump as set forth in claim 7 wherein said spring is a coil spring coupled to said shaft for axially displacing said pitch plate into engagement with said shroud for pivoting said vanes and controlling said pitch angle of said vanes in response to rotation of said shaft.

* * * * *